US005260252A

United States Patent [19]

Frangie et al.

[11] Patent Number: 5,260,252

[45] Date of Patent: Nov. 9, 1993

[54] THERMAL LATENT IMAGE MATERIAL AND METHOD OF PRODUCING AND DEVELOPING THE SAME

[75] Inventors: Frederick G. Frangie; Roberta R. Arbree, both of Nashua, N.H.

[73] Assignee: Nashua Corporation, Nashua, N.H.

[21] Appl. No.: 558,293

[22] Filed: Jul. 24, 1990

[51] Int. Cl.[5] ..... B41M 5/30

[52] U.S. Cl. ..... 503/206; 428/29; 503/209; 503/216; 503/217; 503/221; 503/225; 503/226

[58] Field of Search ..... 427/150-152; 503/206, 201, 226, 209, 217, 216, 221, 225; 428/29

[56] References Cited

FOREIGN PATENT DOCUMENTS 0248784 11/1986 Japan ..... 503/226

*Primary Examiner*—Bruce H. Hess

*Attorney, Agent, or Firm*—Testa, Hurwitz & Thibeault

[57] ABSTRACT

Disclosed is a method and material for producing and developing thermal latent images. Upon imagewise thermal exposure of a heat sensitive recording material, the recording material selectively yields both a latent image and a visually readable image. The latent image may comprise confidential data or text, and may subsequently be rendered visually readable by an authorized recipient.

14 Claims, 3 Drawing Sheets

THERMAL LATENT IMAGE MATERIAL AND METHOD OF PRODUCING AND DEVELOPING THE SAME

BACKGROUND OF THE INVENTION

This invention relates to heat sensitive recording material, and more specifically to such material which may selectively conceal an image until subsequent development.

Heat sensitive recording materials are well known in the art and are fully described in patent and other technical literature. Generally, these materials consist of a support (e.g., paper) having a light or colorless color developing layer formed thereon. The color developing layer comprises one or a mixture of color forming materials, such as leuco dyes, and a developer material, such as an acidic substance, which react together upon the application of heat to produce a dark or black image in a selected area. These heat sensitive recording materials are widely used in facsimile and other printing technology where an image is generated by heating selected areas of the recording material with, for example, a thermal printhead, to generate images.

In facsimile technology a transmitting facsimile apparatus communicates via telecommunication lines with a receiving facsimile apparatus, instructing the receiving apparatus to print text and/or graphic information. Generally, a sheet of text and/or graphic information to be transmitted to a remote location is fed into a transmitting facsimile apparatus where the information it bears is converted to an electronic signal and is transmitted to a desired receiving facsimile. The electronic signal instructs a thermal printhead of the receiving facsimile to be activated and to contact the heat sensitive recording material of the receiving apparatus in a pattern which will produce an image corresponding identically to that on the original sheet fed into the transmitting apparatus.

This technology is now widely used due to its tremendous convenience. However, because this technology conveniently prints transmitted text and/or graphic information in its entirety, one drawback of this technology is the inability to retain the confidentiality of sensitive information at the receiving station. Accordingly, there is a need for heat sensitive recording material which will enable facsimile messages to be concealed selectively to persons other than authorized recipients.

It is thus an object of the invention to provide a heat sensitive recording material capable of maintaining the confidentiality of sensitive electronically-transmitted messages. Another object of the invention is to provide a heat sensitive recording material which bears a visible image as well as a latent image which may be developed subsequently by an authorized recipient. A further object of the invention is to provide a heat sensitive recording material able to be processed with a lower energy input. Other objects of the invention will be apparent from the descriptions, drawings and claims which follow.

SUMMARY OF THE INVENTION

The present invention provides a heat sensitive recording material which is used to print electronically transmitted images and/or data. Upon imagewise thermal exposure of the recording material, the recording material selectively yields both a latent image and a visually readable image. The latent image may comprise confidential data or such other information intended for authorized recipients only. This latent image may subsequently be rendered visually readable by an authorized recipient. Typically, the visually readable image contains non-confidential data such as the identity of the Party transmitting the data and the identity of the intended recipient.

Generally, the heat sensitive recording material of this invention comprises a web or substrate having a surface coating of an imagewise thermally exposable material. In the region of the recording material intended to yield a latent image, the surface coating principally comprises a binder, such as a polymeric binder, having dispersed therein finely divided crystals or particles of an electron-accepting material. Other materials commonly used in preparing heat sensitive coatings, such as dispersants, fillers (pigments), lubricants, sensitizers, stabilizers, and the like, may also be used. Upon imagewise thermal exposure of this region, the electron-accepting material melts to form a solid solution, thus yielding a non-readable latent image. The latent image may be rendered readable by contacting this region with a latent image-developing material, such as an electron-donating material.

While it is preferred to coat the recording material in the latent image-generating region of the material with a binder and an electron-accepting material, it is also possible to provide, alternatively, a binder and an electron-donating material. In such case the latent image can be made readable through subsequent contact with an electron-accepting material.

The surface coating in the region of the recording material intended to yield a fully readable image comprises, in addition to the binder and electron-accepting material, an electron-donating material. The coating in this region also includes other components, mentioned above, which are typically found in the color developing coating of heat sensitive recording material. This region yields readable data without the necessity of further treatment.

It is to be understood that any percentages provided herein are percentages based on the total dry weight of the coating, unless otherwise indicated.

BRIEF DESCRIPTION OF THE DRAWINGS

The foregoing and other objects of this invention, the various features thereof, as well as the invention itself, may be more fully understood from the following description, when read together with the accompanying drawings, in which.

DESCRIPTION

Figure 1:
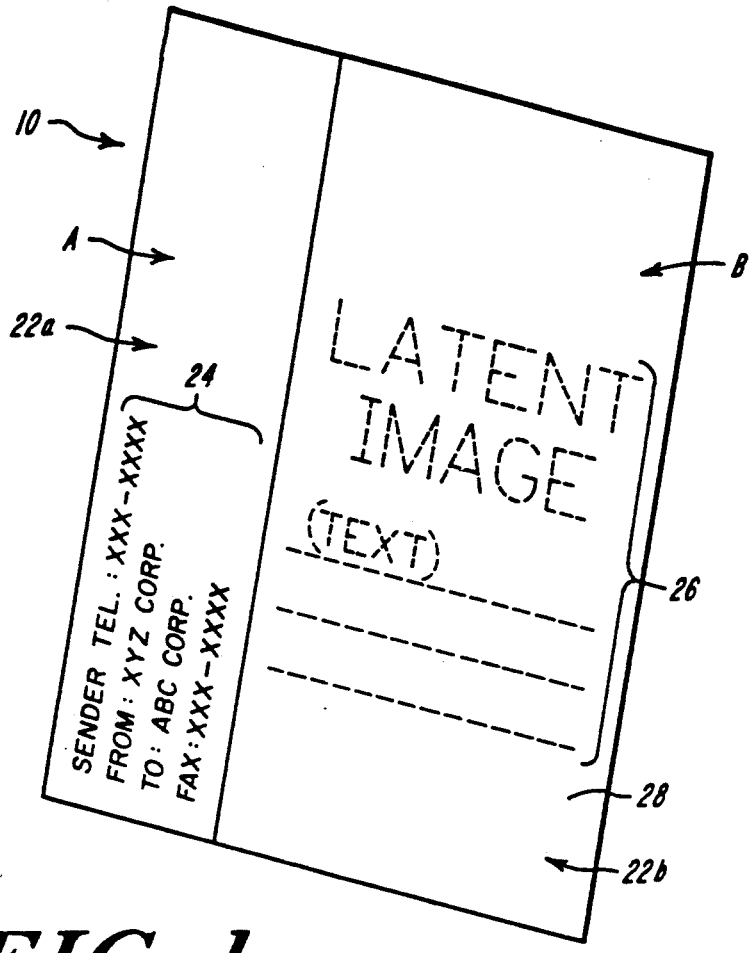
FIG. 1 is a perspective view of a sheet of heat sensitive recording material embodying the invention.

Referring to the drawings, FIGS. 1 and 2 schematically illustrate a sheet of heat sensitive recording material 10 comprising a web or substrate (e.g. paper) 20 having a heat-sensitive color-forming layer 22 applied to one surface thereof. As shown in FIG. 1, the recording material has both visible text 24 and invisible, latent image text 26. The latent image text 26 may be converted to readable text in the manner described below.

Layer 22 is a thermally sensitive, imagewise exposable layer which preferably may be divided into two distinct regions, region A and region B. The coating 22*a* of region A may comprise virtually any type of thermal coating known in the art, and preferably contains one or more electron-donating materials (e.g., leuco dyes) and electron-accepting materials (e.g., acidic materials), disposed in a binder together with various additives including stabilizers, whitening agents, dispersants, fillers, sensitizers, and lubricants. Upon imagewise exposure to heat, such as occurs during transmission in a facsimile machine, the electron-donating and electron-accepting materials melt and react to form the transmitted image which is readily visible.

Region B is intended for recordation of a latent image 26, usually comprising confidential text, data, or other information. The latent image 26, displayed in region B, is visually indistinguishable from the background area 28 of region B. The visually indistinguishable latent image 26 may include an image which is discernable when viewed in particular wavelengths of light (e.g., in very bright light), or when the web is viewed carefully from an oblique angle. The latent image 26 may be developed subsequently (i.e., at a time later than the time of initial transmission of information) by an authorized recipient of the transmission.

Generally, the coating 22*b* in region B may comprise one which is sometimes referred to in the art as the "B mix" component of the color developing layer. That is, coating 22*b* comprises an electron-accepting material (i.e., a developer) which is dispersed, in a crystalline state, within a polymeric binder together with additives including dispersant, sensitizer, filler, stabilizer and a wax or lubricant. Coating 22*b* differs from coating 22*a*in that it is devoid of an electron-donating material such as a leuco dye. As a result, upon thermal imagewise exposure of region B, a latent image 26 is formed. This latent image 26 is virtually invisible following transmission of the image, and it is thus useful for conveying confidential information. The latent image 26 may easily be converted to a readable format upon application (preferably by an authorized recipient) of an electron-donating material to region B of the recording material 10.

The information transmitted onto the recording material 10 may include alphanumeric or graphic information. This information, or data, may be transmitted electronically, via digital or analog transmission means, and must generally be heat-transferred onto the material of the invention.

It will be apparent to one skilled in the art that the coating of region B may include an electron-donating material rather than an electron-accepting material, and may thus correspond to what is sometimes referred to in the art as the "A mix" component of a color developing layer. In such an embodiment a latent image may be developed by applying the electron-accepting material (i.e., developer) to region B.

The electron-donating materials for use in the present invention (such as in coating 22*a*) may be of the type generally known in the art. Typically, these are pale or colorless materials which may be activated (i.e., develop color) alone or in combination with other such materials following contact with an electron-accepting (acidic) substance. Such electron-donating materials may include all of the leuco dyes commonly used for heat sensitive recording materials, including triphenylmethane leuco dyes, fluoran-type leuco dyes, phenothiazine-type leuco dyes, auramine-type leuco dyes, spiropyran-type leuco dyes and rhodamine-type leuco dyes. Generic and specific examples of such electron-donating materials (e.g., dyes) are disclosed in U.S. Pat. Nos. 4,370,370; 4,593,298; and 4,839,332, all of which are hereby incorporated by reference. Exemplary electron-donating materials include 3-N-cyclohexyl, N-methyl-amino, 6-methyl-7-anilino fluoran and 3-pyrrolidino-6-methyl-7-anilino fluoran. Preferred electron-donating materials include the following dyes which may be used in combination or separately: 3-isopentyl ethyl amino-6-methyl-7-anilino fluoran; 3-isobutyl ethyl amino-6-methyl-7-anilino fluoran; 3-diethylamino-6-methyl-7-anilino fluoran; 3-N-ethyl-N-tetrahydrofurfurylamino-6-methyl-7-anilino fluoran; and crystal violet lactone.

Similarly, the electron-donating material which is separately applied to latent image-containing heat sensitive recording material to convert the latent image to a readable image includes the leuco dyes which are identified above, as well as other such compounds well known in the art.

Many electron-accepting (acidic) substances which function as developer materials in the color developing layer of heat sensitive recording material are well known in the art and may be used in forming the coating 22*b* applied to region B of sheet 10. These materials are, of course, also used in the coating 22*a* of region A. A number of such compounds are disclosed in U.S. Pat. Nos. 4,721,700 and 4,885,271, which are hereby incorporated by reference. Generally, such developer compounds include organic electron acceptors such as phenolic compounds, and aliphatic and aromatic carboxylic acids and their polyvalent metal salts. These materials are characterized by their ability to induce a color change in a leuco dye. Specific examples of preferred developers which may be used with the present invention are 4-hydroxy-4' isopropoxy diphenyl sulfone, bisphenol A, bisphenol S, and benzyl p-hydroxybenzoate.

Sensitizing compounds commonly are used in association with the developer compounds (i.e., in region A and/or region B) to lower the melting point of the developer to reduce the required energy input. Many such sensitizers are known in the art and may be used in the recording material of the present invention. Preferred sensitizers include parabenzyl biphenyl, dimethyl benzyl oxalate, M-terphenyl, diphenoxyethane, benzyl ester of p-nitro benzoic acid (e.g., "Nipafax BPN", available from Nipa Laboratorries, Ltd., of Glamorgan, U.K.), 2-benzyloxy-naphthalene, dibenzyl terephthalate, dibenzyl oxalate, and diphenyl carbonate. These sensitizers are generally used in weight percentages in the range of 2.0 to 25.0 and most preferably 4 to 10.

The polymeric binder used in coating 22 (in both regions A and B) comprises one or a mixture of resinous materials which act to hold the other constituents of the layer 22 together, and to bind them to the substrate. The binder typically comprises about 2 to 15 percent of the total coating composition for region A and about 3 to 8 percent of the total coating composition in region B. The currently preferred binder material is a low viscosity polyvinyl alcohol. Other known binders which may be used include polyvinyl pyrrolidone, polyacrylamide, starches, modified starches and modified cellulosics. Latex emulsions such as acrylics, styrene butadiene rubbers, and polyurethanes may be used as well. Exemplary polyvinyl alcohols which may be used in the present invention include AIRVOL TM 107, 125, 165, 203, 205, 325, 350, 425, 523, 540, 704, 714, and 736, all of which are available from Air Products and Chemicals, Inc., Allentown, Pa. Other types of polyvinyl alcohol may be used, including ELVANOL TM 75-15 available from DuPont. Polyvinyl alcohol binders used with the present invention may be partly or fully hydrolyzed.

The same binder material need not necessarily be used in both regions A and B of the coating. In a preferred embodiment, region B may comprise a fully hydrolyzed polyvinyl alcohol while region A comprises a partly hydrolyzed (e.g., about 80%) polyvinyl alcohol. Coatings 22*a* and 22*b* both typically include various inert processing and property improving materials. Such inert materials include neutralizing agents, fillers (pigments), lubricants, dispersants, and defoaming agents, all of which are present in relatively minor amounts.

Preferred fillers (pigments) include alumina trihydrate, calcium carbonate, calcined clay, silicon dioxide, talc and clay. Other filler materials well known in the art may be included as well. These materials may be present alone or in combination with each other. Typically, these materials are present as dispersed particles having a diameter of about 1 micron. Fillers typically are present in the coating at about 25 to 65 percent, depending upon the filler composition.

The coating 22 may include an antioxidant or stabilizing material of the type commonly used in the manufacture of heat sensitive recording material to preserve both latent and developed images. The need for antioxidants, as is well known in the art, is dependent upon the choice of developer. A preferred stabilizer is 1,1,3-tris (2-methyl-4-hydroxy-5-t-butylphenyl) butane. Such a material is available under the trade name "AO-30" from Nagase America Corporation, New York, N.Y. In the preferred composition, AO-30 comprises approximately 15 to 6.5 percent of the total composition.

The dispersants and lubricants which may be used with the present invention are well known in the art and are widely used in the manufacture of thermal paper. Exemplary dispersants include polyacrylate compounds, polyvinylpyrrolidone and the ammonium salt of styrene acrylic acid copolymer. Exemplary lubricants include zinc stearate, amine wax, paraffin wax and carnuba wax.

In one important aspect of the invention, the latent image may be formed as heat applied at a pixel converts crystalline developer into a solid solution of developer, sensitizer (if present) and binder. Developers of the preferred embodiment initially are present in the coating in crystalline form, and later dissolve into a solid solution in areas which are subjected to heat. Thus, latent images may be formed by selectively melting regions of coated paper, such as melting the developer in areas where an image is desired while leaving the developer in crystalline form in other areas. While in crystalline form, the developer generally will not react with a color former such as an electron-donating material, or will react inefficiently. However, as long as the developer remains in solid solution form, it may be reacted with a dye to form a visually readable image. Thus, a preserved or stabilized latent image may be stored for subsequent development by an authorized recipient.

In some instances a latent image may be lost as the solid solution recrystallizes. However, the presence of sensitizer compounds tends to prevent recrystallization of the latent image, or at least to provide greater longevity to the latent image. One skilled in the art will readily appreciate that the longevity of the latent image may be controlled by the choice of sensitizer compounds.

Heat sensitive recording materials of the present invention may be prepared by coating a substrate or web (e.g., paper) with color developing layers. The general methods of applying coatings to a paper substrate to produce a heat sensitive recording material, which are well known in the art, are applicable to the present invention. However, in the preparation of the recording material of the present invention, separate coatings, each having different components, are preferably used to form regions A and B of coating 22.

Figure 2A:
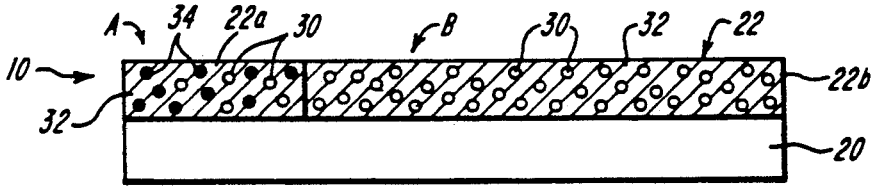
FIG. 2A is a schematic cross-sectional view of a sheet of heat sensitive recording material embodying the invention.

In one embodiment region A is formed by coating a portion of the web or substrate (preferably in a lengthwise direction, as shown in FIG. 1) with a coating material ("Mix 1") which may be of virtually any type widely used as a coating in preparing conventional thermal recording material. Region B, which typically is much wider than region A, is then prepared by applying another coating material ("Mix 2") to the previously uncoated portion of the web. A recording material 10 prepared in this manner is shown in FIG. 2A.

Figure 2B:
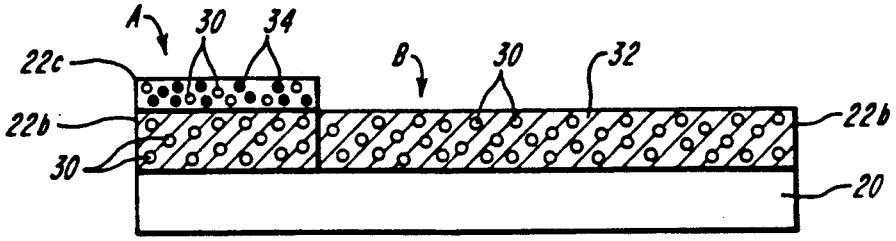
FIG. 2B is a schematic cross-sectional view of a sheet of heat sensitive recording material providing an alternate embodiment of the invention.

In another coating method, the result of which is illustrated in FIG. 2B, a coating 22*b* ("Mix 2") is applied to one surface of the entire substrate 20. Once coating 22*b* is dried, coating 22*a* ("Mix 1") is applied to one section (preferably a lengthwise strip) of substrate 20 to form region A. Coatings 22*a* and 22*b* are both described above.

It is also possible to form the coating 22*a* by applying, in separate layers, a coating composition containing the electron-donating materials and a coating composition containing the electron-accepting material.

The total coating weight is well known in the art, and preferably is in the range of from about 1 to 10 grams per square meter. Most preferably the coating weight is about 4 to 6 grams per square meter.

As noted above, the recording material of this invention may be used in devices, such as facsimile machines, where confidentiality of a facsimile transmission is desired. In operation, the recording material is operably disposed within a receiving facsimile. Through an electronic signal generated by a transmitting facsimile, the thermal printhead of the receiving apparatus is activated to contact the recording material, melting the color developing coating 22 in selected areas so as to produce the transmitted image. The image in region A is visible, while that of region B is latent. The latent image may be converted to a visible image by applying an electron-donating material (e.g., a leuco dye which is maintained in a semi-solid or liquid solution together with an oil and a wax) to region B of the recording material. When the solution containing the electron-donating material mixes with the solid solution of region B, the latent image becomes visible.

Figure 4:
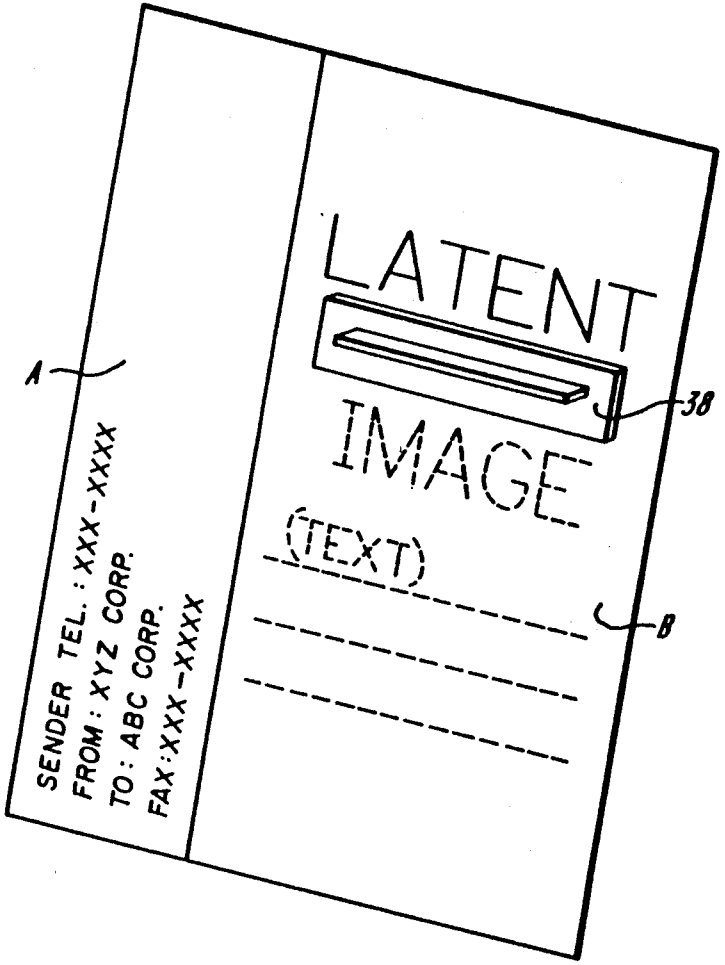
FIG. 4 is a schematic of a wiper apparatus containing a latent image-developing material which may be used in conjunction with the recording material of FIG. 1.
Figure 3:
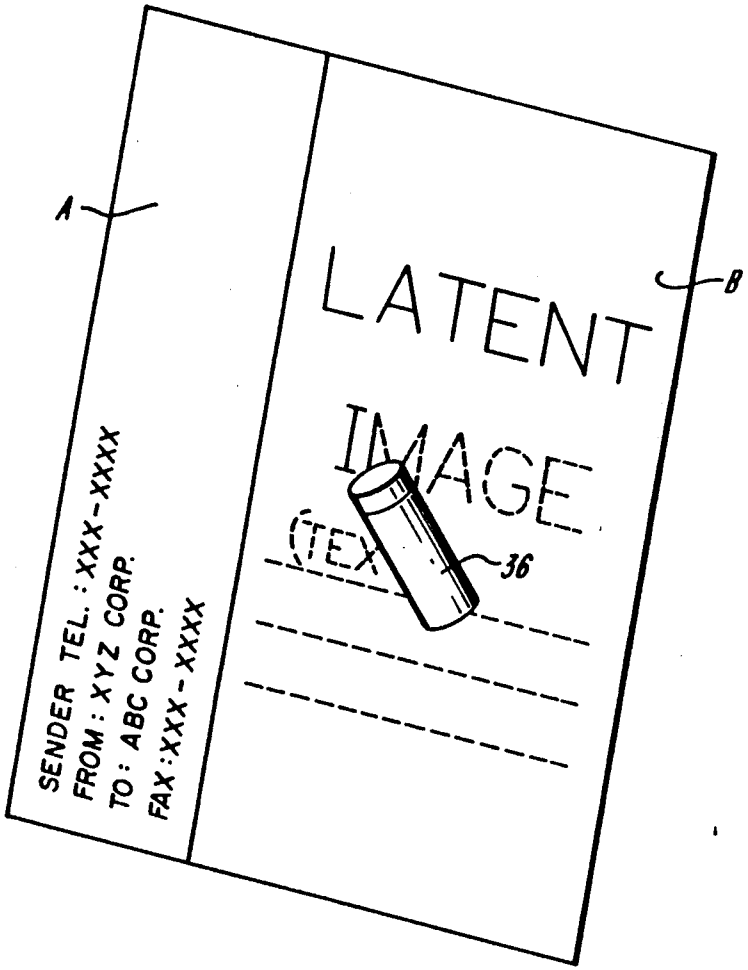
FIG. 3 is a schematic view of a latent image-developing apparatus which may be used in conjunction with the recording material of FIG. 1.
Figure 5:
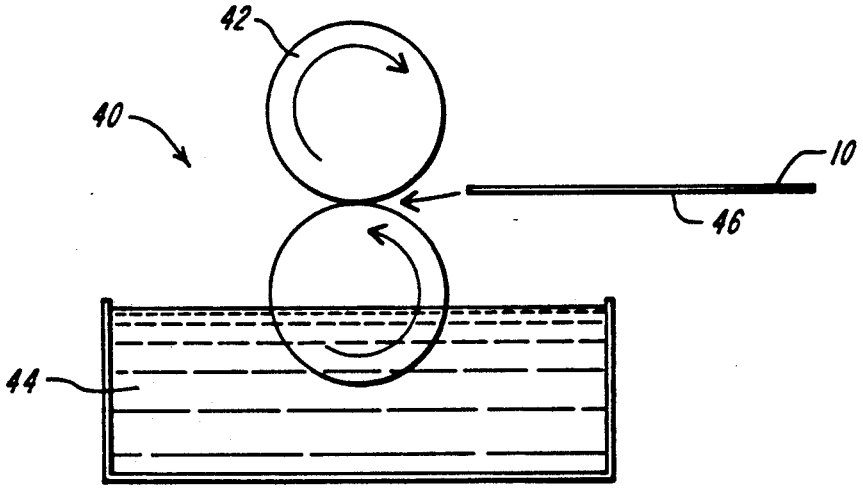
FIG. 5 is a schematic side view of an alternate latent image-developing apparatus which may be used in practicing the method of the invention.

Various means for applying the electron-donating material to the latent image are shown in FIGS. 3–5. FIG. 3 shows the application of the electron-donating material in the form of a wax stick 36 which may contain, in a semi-solid solution, a wax, an oil and a dye. The wax stick 36 may be hand-held and selectively drawn across the latent image portion, region B, of a facsimile transmission. In one embodiment, the wax stick may comprise crystal violet lactone as the electron-donating material, as well as di-isopropyl naphthalene and a paraffin wax.

Such a wax stick may be prepared, for example, by adding about 5 grams of crystal violet lactone to a mixture of 150 grams of di-isopropyl naphthalene manufactured by Kureha Chemical Industry Co. of Tokyo and 150 grams of paraffin wax having a melting point of 125° F. The mixture may be heated to 150° F. until it forms into a clear solution and may then be formed into a solid having a desired shape. This formulation is provided by way of example only, and it is understood that other formulations may be used to achieve the same desired results.

FIG. 4 shows an alternate means of applying the dye, in which a wiper-type applicator 38 contains a dye, a dye solvent and/or carrier. Dyes suitable for use in this embodiment of the invention include the electron-donating materials mentioned above. Exemplary carrier include paraffin wax, amine wax, carnuba wax and various other materials well known in the art.

FIG. 5 shows an additional application means in the form of an applicator apparatus 40, having a pair of opposing, rotating rollers 42 for receiving the image-wise thermally exposed recording material 10. The rollers 42 move the web 20 through a dye solution 44 which may comprise the electron-donating materials mentioned above. The developed web may then be passed through a second pair of drying rollers (not shown), or allowed to air dry.

The following examples illustrate various coating formulations which may be used to prepare the heat sensitive recording material of the invention.

EXAMPLES Example 1

Mix 1 (i.e., coating 22*a*) may be made by preparing the following dispersions shown below as Mix A (numbers 1–3) and Mix B (numbers 1–3).

Color Forming Layer--Region A

| Formula Components | parts by weight (wet) | Function |
|---|---|---|
| Mix A-1 | | |
| polyvinyl alcohol (approx. 10% solution) | 110 | binder |
| 3-N-cyclohexyl, N-methyl amino-6-methyl-7-anilino fluoran | 50 | dye |
| Foamaster P | 0.1 | defoamer |
| water | 140 | |
| Mix A-2 | | |
| polyvinyl alcohol (approx. 10% solution) | 100 | binder |
| crystal violet lactone | 60 | dye |
| Foamaster P | 0.1 | defoamer |
| water | 160 | |
| Mix A-3 | | |
| carboxy methyl cellulose (approx. 10% solution) | 110 | binder |

-continued

Color Forming Layer--Region A

| Formula Components | parts by weight (wet) | Function |
|---|---|---|
| 3 pyrrolidino-6 methyl-7 anilino fluoran | 55 | dye |
| Foamaster P | 0.1 | dye |
| water | 145 | |

Each of the above Mix A-1 through A-3 may be prepared by first dispersing the ingredients in the water using a Baranco mixer for 15 minutes, and then reducing the particle size by way of attrition for 60 minutes.

| | | |
|---|---|---|
| Mix B-1 | | |
| polyvinyl alcohol (approx. 10% solution) | 100 | binder |
| water | 140 | |
| acrylic polyelectrolyte ("DARVAN No. 7) | 2.0 | dispersant |
| zinc stearate | 10.0 | lubricant |
| aluminum trihydrate | 27.5 | filler |
| p-benzyl hydroxybenzoate | 20.0 | developer |
| calcium carbonate | 2.5 | filler |
| Mix B-2 | | |
| polyvinyl alcohol (approx. 10% solution) | 100 | binder |
| water | 140 | |
| arcrylic polyelectrolyte (DARVAN No. 7) | 2.0 | dispersant |
| stearic acid amide | 10.0 | lubricant |
| talc | 28.0 | filler |
| bis-phenol A | 20.0 | developer |
| calcium carbonate (particulate) | 3.0 | filler |

Each of the Mix B-1 and B-2 may be prepared by dispersing the ingredients using a mixer for 15 minutes after all of the dry components are added together. The ingredients are added to the mix tank in the order shown above. The particle size is reduced by way of attrition for 30 minutes.

To produce Mix 1, any one of the Mix A dispersions may be combined with any of the Mix B dispersions at a ratio of 5 to 15 parts Mix A per 50 parts Mix B. The blend is then coated onto paper, e.g. 39 pound (24×36), and dried to produce a dry coating weight of approximately 6 grams per square meter.

Example 2

A latent image-producing coating may be prepared with the formulations shown below and identified as Mixes B-3, B-4, B-5, and B-6 (hereinafter referred to as Mix 2).

Latent Image-Producing Coating--Region B

| Formula Components | % of Formula | Function |
|---|---|---|
| Mix B-3 | | |
| polyvinyl alcohol | 7.1 | binder |
| benzyl hydroxybenzoate | 23.2 | developer |
| dibenzyl terephthalate | 4.1 | sensitizer |
| zinc stearate | 6.4 | lubricant |
| AO-30 | 4.1 | stabilizer |
| DARVAN TM | 0.5 | dispersant |
| calcium carbonate | 46.0 | whitening agent/filler |
| calcined clay | 8.6 | filler |
| Mix B-4 | | |
| polyvinyl alcohol | 7.5 | binder |

-continued

| Latent Image-Producing Coating--Region B | | |
|---|---|---|
| Formula Components | % of Formula | Function |
| benzyl hydroxybenzoate | 21.6 | developer |
| dibenzyl terephthalate | 4.7 | sensitizer |
| zinc stearate | 7.5 | lubricant |
| AO-30 | 4.7 | stabilizer |
| DARVAN TM 7 | 0.6 | dispersant |
| magnesium silicate | 53.4 | filler |
| Mix B-5 | | |
| polyvinyl alcohol | 7.2 | binder |
| bisphenol A | 26.5 | developer |
| dibenzyl oxalate | 13.2 | sensitizer |
| DARVAN TM 7 | 0.2 | dispersant |
| alumina trihydrate | 52.9 | filler |
| Mix B-6 | | |
| polyvinyl alcohol | 8.3 | binder |
| 4-hydroxy-4' isopropoxy diphenyl sulfhone | 20.9 | |
| Kem W40 | 12.5 | amide wax |
| zinc stearate | 12.5 | lubricant |
| diphenyl carbonate | 14.3 | sensitizer |
| Lupasol 208 | 0.3 | dispersant |
| calcium carbonate | 18.7 | filler |
| calcined clay | 11.3 | filler |
| carboxy methyl cellulose | 1.2 | binder |

Lupasol 208 is an ammonium salt of a styrene acrylic acid copolymer, available from BASF.

The components of each formula for Mixes B-3, B-4, B-5, and B-6 may be mixed and ground in an attritor for 30 minutes. The attrited mixture is then coated on paper and dried to give a coating weight of 6 grams per square meter. In addition, mixes B-1 and B-2, presented above, may be used to prepare a coating material (i.e., Mix 2) for region B. Any one of mixes B-1 through B-6 may be coated upon a substrate at 6 g/m$^2$ to produce a region B-type coating.

Example 3

A solid composition containing a dye material for converting a latent image to a visible image was prepared as follows. Approximately 5 grams of crystal violet lactone were added to a mixture of 150 grams of di-isopropyl naphthalene and 150 grams of paraffin wax having a melting point of 125° F. The mixture coating heated to 150° until forming a clear solution. The mixture was then cooled and formed into an elongate shape.

Example 4

Samples of a heat sensitive recording material were coated at 6 g/m$^2$ with a coating composition containing an electron-accepting material which was devoid of an electron-donating material. Each sample of the recording material was contacted with a heated metal bar having a temperature of 215° F. The heated bar was applied for a duration of 5 seconds at a pressure of 3 pounds per square inch. Upon removing the heated bar, each sample appeared to be substantially devoid of any discoloration in the area where the heated bar was applied. Subsequently samples were contacted with both a crystal violet lactone dye and 3-isobutyl ethyl amino-6-methyl-7-anilino fluoran dye or to reveal the latent image. Table I, shown below, illustrates the optical density of the developed latent image (using the Step-wedge tester at 215° F.) as compared to the optical density of the background for both dye materials used to reveal the latent image.

TABLE I

| Region B Coating | | | | | | OPTICAL DENSITY | | | |
|---|---|---|---|---|---|---|---|---|---|
| | | | | | | Crystal violet lactone | | 3-isobutyl ethyl amino-6-methyl-7-anilino fluoran | |
| Developer | Sensitizer | Binder | Filler | Stabilizer | Wax | Image | BKGD | Image | BKGD |
| BHB | | PVA | CaCO3 | AO-30 | ZnSt | 0.86 | 0.07 | 0.99 | 0.12 |
| BHB | DBT | PVA | CaCO3 | AO-30 | | 0.81 | 0.08 | 0.94 | 0.11 |
| BHB | DBT | PVA | CaCO3 | | ZnSt | 0.90 | 0.07 | 1.20 | 0.11 |
| Bis A | | PVA | Al.Hyd | | | 0.12 | 0.01 | 0.19 | 0.13 |
| Bis A | DBO | PVA | Al.Hyd | | | 0.55 | 0.11 | 0.54 | 0.13 |
| BHB | DBT | PVA | Talc | AO-30 | ZnSt | 0.69 | 0.10 | 0.80 | 0.21 |
| BHB | DBT | HPC | CaCO3 | | ZnSt/W | 0.35 | 0.09 | 0.75 | 0.20 |
| D-8 | DPC | PVA | CaCO3/Clay | | ZnSt/W | 0.76 | 0.08 | 0.77 | 0.11 |
| BHB | DPC | PVA | CaCO3 | | ZnSt | 0.70 | 0.08 | 0.88 | 0.11 |
| MHB | | PVA | A1H/CaCO3 | AO-30 | | 0.30 | 0.08 | 0.64 | 0.13 |
| BHB | DBT | PVA | CaCO3/Clay | AO-30 | ZnSt | 0.90 | 0.10 | 0.98 | 0.13 |

Abbreviations in Table I:

| | |
|---|---|
| BKGD | denotes background |
| BHB | denotes benzyl hydroxy benzoate |
| Bis A | denotes bisphenol A |
| D-8 | denotes 4-hydroxy-4'-isopropoxy-diphenyl sulfone |
| MHB | denotes methyl hydroxybenzoate |
| DBT | denotes dibenzyl terphthalate |
| DBO | denotes dimethyl benzyl oxalate |
| DPC | denotes diphenyl carbonate |
| PVA | denotes polyvinyl alcohol |
| HPC | denotes hydroxy propyl cellulose |
| Al-Hyd | denotes alumina trihydrate |
| AO-30 | denotes 1,1,3-tris (2-methyl-4-hydroxy-5-butylphenyl) butane |

The invention may be embodied in other specific forms, not delineated in the above examples, without departing from the spirit and scope thereof. Other embodiments are within the following claims.

What is claimed is:

1. A web having a surface coating comprising a first region comprising a binder having dispersed therein an electron-accepting material capable of inducing a color change upon exposure to an electron-donating material, and having an imagewise thermally exposed data-containing area which is visually indistinguishable from an unexposed background area of said first region, wherein said thermally exposed area of the first region comprises a solid solution of said electron-accepting material, and wherein said unexposed area of said first region comprises dispersed particles of said electron-accepting material, said first region being receptive selectively to a latent image-developing material comprising said electron-donating material which when applied to said surface produces a visually readable contrast between said exposed and unexposed areas; and a second region having an imagewise thermally exposed data-containing area having visually readable data contrasting with an unexposed background area of said second region.

2. The web of claim 1 wherein said electron-donating material is selected from the group consisting of 3-isobutyl ethyl amino-6-methyl-7-anilino fluoran; 3-diethylamino-6-methyl-7-anilino fluoran; 3-isopentyl ethyl amino-6-methyl-7-anilinofluoran; 3-N-ethyl-N-tetrahydrofurfurylamino-6-methyl-7-anilino fluoran; and crystal violet lactone.

3. The web of claim 1 wherein said first region bears a latent, invisible image of confidential data and said second region bears a visible image of non-confidential data.

4. The web of claim 1 wherein said electron-accepting material is selected from the group consisting of 4-hydroxy-4' isopropoxy diphenyl sulfone; bisphenol A; bisphenol S; and benxyl p-hydroxy benzoate.

5. The web of claim 1 wherein the coating of said first region further includes sa sensitizer selected from the group consisting of dibenzyl terephthalate; dibenzyloxalate; diphenyl carbonate; and dimethyl benzyl oxalate.

6. The web of claim 1 wherein the visually readably data of said second data-containing region comprises at least one electron-donating material and an electron-accepting material which, upon imagewise thermal exposure, react to form a color.

7. The web of claim 6 wherein at least one of said electron-donating materials is a leuco dye selected from the group consisting of 3-isobutyl ethyl amino-6-methyl-7-anilino fluoran; 3-N-ethyl-N-tetrahydrofurfurylamino-6methyl-7-anilino fluoran; and crystal violet lactone.

8. A web for receiving electronically transmitted confidential information and non-confidential information, said web comprising on a surface thereof:

first and second data-receiving regions;

said first region comprising a first coating comprising a binder having dispersed therein particles of an electron-accepting material capable of inducing a color change upon exposure to an electron-donating material which, upon imagewise exposure, produces a latent thermal image comprising the confidential information, developable by applying said electron-donating material to a visually readable form; and said second region comprising a second coating comprising both electron-donating and electron-accepting materials which, upon imagewise thermal exposure, produces a visually readable image corresponding to the non-confidential information.

9. The web of claim 8 wherein the second coating comprises an electron-donating material and an electron-accepting material, both disposed in a binder which, upon imagewise thermal exposure, produces a visible image as said electron-donating and electron-accepting materials react to form a colored complex.

10. A web having a surface coating comprising a first region comprising a binder having dispersed therein particles of an electron-accepting material which upon imagewise thermal exposure melts to form a solid solution of said electron-accepting material, which exposed area is visually indistinguishable from an unexposed background area of said first region, said first region being receptive selectively to a latent image-developing electron-donating material applied to said surface to produce a visually readable contrast between said exposed and unexposed areas, wherein said electron-accepting material is capable of inducing a color or an image upon exposure to the electron-donating material.

11. The web of claim 10 wherein said coating further comprises a second region having an imagewise thermally exposed data-containing area having visually readable data contrasting with an unexposed background area of said second region.

12. The web of claim 10 wherein the electron-accepting material is selected from the group consisting of 4-hydroxy-4' isopropoxy diphenyl sulfone; bisphenol A; bisphenol S; and benzyl p-hydroxy benzoate.

13. The web of claim 10 wherein the electron-donating material is selected from the group consisting of 3-isobutyl ethyl amino-6-methyl-7-anilino fluoran; 3-diethylamino-6-methyl-7-anilino fluoran; 3-isopentylethylamino-6-methyl-7-anilino fluoran; 3-N-ethyl-N-tetrahydrofurfurylamino-6-methyl-7-anilino fluoran; and crystal violet lactone.

14. The web of claim 10 wherein the coating of said first region further includes a sensitizer selected from the group consisting of dibenzyl terephthalate; dibenzyloxalate; diphenyl carbonate; and dimethylbenzyl oxalate.

* * * * *